United States Patent [19]

Vecchiarelli

[11] 4,180,118

[45] Dec. 25, 1979

[54] CORD LOCK MECHANISM FOR VENETIAN BLIND

[75] Inventor: Francis Vecchiarelli, River Edge, N.J.

[73] Assignee: Hunter Douglas International N.V., Curacao, Netherlands Antilles

[21] Appl. No.: 924,309

[22] Filed: Jul. 13, 1978

[51] Int. Cl.[2] ..... E06B 9/38; E06B 9/322

[52] U.S. Cl. ..... 160/178 C; 24/136 A; 188/65.1

[58] Field of Search ..... 160/178 C; 24/115 G, 24/115 M, 136 R, 136 A, 244, 263 SW; 188/65.1; 182/5

[56] References Cited

U.S. PATENT DOCUMENTS

| | | | |
|---|---|---|---|
| 198,527 | 12/1877 | Wethered | 160/178 C |
| 1,457,029 | 5/1923 | Hazlett et al. | 160/178 C |
| 1,482,268 | 1/1924 | Schopper | 188/65.1 |
| 2,155,945 | 4/1939 | Lewis | 160/178 C |
| 2,172,657 | 9/1939 | Haase | 160/178 C |
| 3,294,153 | 12/1966 | Fountain | 160/178 C |
| 3,756,565 | 9/1973 | Sakai | 188/65.1 |
| 3,952,789 | 4/1976 | Marotto | 160/178 C |
| 4,049,303 | 9/1977 | Irwin et al. | 24/136 A |

*Primary Examiner*—Peter M. Caun

*Attorney, Agent, or Firm*—Pennie & Edmonds

[57] ABSTRACT

A cord locking mechanism is described for a venetian blind for locking the flexible blind lifting and lowering member in any selected position by gripping the member between a guide and a serrated locking pin movable toward and from the guide; a helper member is movable toward and from the locking pin when in its unlocked position in order to insure engagement of the flexible member with the locking pin and movement of the locking pin into a locking position.

8 Claims, 9 Drawing Figures

CORD LOCK MECHANISM FOR VENETIAN BLIND

BACKGROUND OF THE INVENTION

In recent years there has come into use a slim or trim style of venetian blinds in which the slats and headrail are generally about 1" in width or even slightly less. In keeping with the slim styling the lifting cords, which raise and lower the blind, are of relatively lightweight and small in diameter, being approximately 1/16th of an inch in diameter in many cases. The locking mechanisms for locking the cords in any adjusted position of the blind from fully raised to fully lowered generally comprise a housing mounted in the headrail. Within the housing there is rotatably mounted a guide roller. A second roller or locking pin, generally serrated about its circumference, is also mounted in the locking mechanism housing in a pair of spaced tracks or slots. The locking pin being loosely mounted in the slots of the housing may rotate with respect to the housing and may also move along the slots or tracks between two limit positions. In the first limit position the locking pin is closely adjacent to the guide roller and serves to grip the lifting cord between the guide roller and the serrated surface of the locking pin. When it is desired to adjust the blind the cord is pulled in one direction (downwardly) whereupon the locking pin drops to the second limit position in which it is spaced away from the guiding roller sufficiently to permit the lifting and lowering cord to move in either direction about the guiding roller to raise or lower the blind without interference from the locking pin. Upon release of the flexible cord the weight of the blind then attempts to pull the flexible cord upwardly and to drop to the fully lowered position of the blind; however, the flexible lifting and lowering cord, when pulled by the weight of the blind, engages the serrated surface of the locking pin and moves the short distance necessary to cause the locking pin to grip the cord between itself and the guide roller thus preventing a further downward movement of the blind. Thus, the weight of the blind, in attempting to drop down, can do so only to a very limited extent (usually only a fraction of an inch) before the cord is pinched and locked.

It will be appreciated that with such thin, lightweight cord, the tolerances with respect to the movement of the locking pin to and from the two limit positions and, importantly, the downward angle at which the flexible cord hangs from the guide roller, become critical and are very small. The weight of the very lightweight cord alone is what causes the engagement of the cord with the locking pin, causing it to move from the unlocked to the locked position. If for any reason the locking cord does not adequately engage against the locking pin when it is in its unlocked position, it will simply pass thereby under the weight of the blind until the blind is fully lowered. This situation is aggravated by the fact that such cords are conventionally of synthetic materials which tend to be glossy or slippery. Accordingly, it is very important that the guiding roller be so positioned, with respect to the locking pin, when the locking pin is in the unlocked position, as to guarantee engagement sufficiently between the cord and the locking pin.

For some time the guiding roller has been made of lignum vitae. This material has proven to be capable of accurate machining and to be relatively immune to changes in humidity. As such, the guiding roller has heretofore been readily capable of insuring the proper engagement between the lifting cord and the locking pin. However, in recent years lignum vitae has become increasingly impossible to obtain, and alternate materials have been substituted. Plastics, impregnated woods and the like, have been tried but have been found to be either too expensive or too variable dimensionally for any number of reasons including response to humidity and temperature to insure proper engagement of the cord with the locking pin. The problem is aggravated by the fact that attempts to cull out unsatisfactory rollers at the plant are not one hundred percent successful, and as a result customer complaints, once the device is in use, have tended to increase with attendant increases in costs for retrofitting with proper rollers.

BRIEF SUMMARY OF THE INVENTION

In order to overcome the difficulties mentioned above, applicant has discovered novel means for insuring adequate contact between the locking cord and the locking pin when the pin is in its unlocked position thus in turn insuring that the pin is positively moved by the upward movement of the cord over the guide roller into the locked position of the locking pin. To accomplish the described contact between the cord and the locking pin, applicant provides in the locking mechanism housing, a helper means movable toward and away from the unlocked position of the locking pin. When the operator has adjusted the blind to the desired height and releases the cord, the helper means moves to a position close to the unlocked position of the locking pin and carries with it the lifting cord. In so doing, the helping means insures adequate engagement of the cord with the locking pin. The locking pin is then moved by the cord to its locked position holding the cord and the blind in the adjusted desired position. When the operator then desires to readjust the blind, he grasps the cord and moves it in a direction to move the helper means away from the unlocked position of the locking pin. This movement also permits the locking pin to drop to its unlocked position whereupon the cord may be moved in either direction over the guiding roller to raise or lower the blind. By this means the engagement of the locking pin in secured but freedom to raise and lower the blind is not in any way impeded or interfered with. The helper means may take any one of several forms including a third roller mounted in a tracks or slots in the housing, a flat spring of suitable shape which may also incorporate the guiding function, and a combination guide and helper mounted loosely on a pin fixed to the housing.

BRIEF DESCRIPTION OF THE DRAWINGS

The construction of the locking mechanism of the invention and its manner of operation will be apparent to those skilled in the art from the following specification and drawings in which.

DETAILED DESCRIPTION OF THE INVENTION

Figure 1:
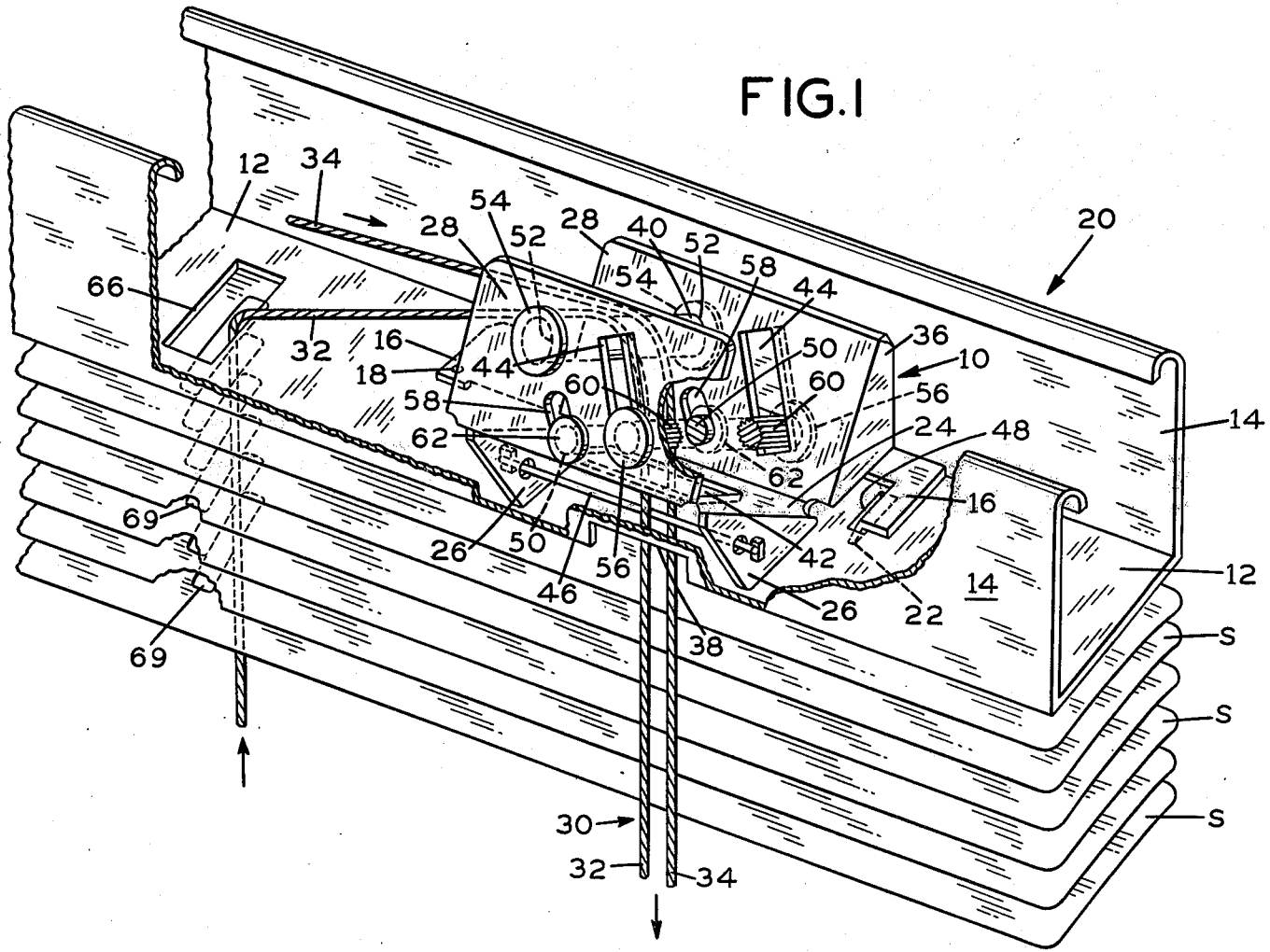
FIG. 1 is a perspective view of one upper corner of a blind including the headrail and locking mechanism of the invention with portions broken away.

FIG. 1 shows the locking mechanism generally indicated at 10 mounted in the headrail 20 of a venetian blind having a plurality of slats S only a few of which are shown. The headrail 20 has a bottom wall 12 and two upstanding generally parallel spaced side walls 14 and an open top. The locking mechanism 10 has a bottom portion 16 secured to the bottom 12 of the headrail 20 at one end (the righthand end in FIG. 1) by a downwardly struck securing leg 22 which engages in an opening 48 in the bottom wall 12 of the headrail 20. At its opposite end (the lefthand end in FIG. 1) the bottom 16 of the locking mechanism 10 is secured to the bottom 12 of the headrail 20 by a rivet 18.

The housing also includes a sloped portion 24 having downwardly struck generally triangular corner support members 26. These members 26 generally fit into the corner between the bottom 12 and one of the said walls 14 of the headrail 20. A cord separation and alignment pin 46 is loosely mounted in holes in the corner members 26. This separation and alignment pin 46 is positioned between the two cords 32 and 34 of the raising and lowering flexible cord 30 and serves to prevent their twisting around each other.

The housing of the locking mechanism 10 also includes substantially parallel spaced upwardly extending walls 28. As shown, the walls 28 are not parallel to the headrail walls 14 but are generally arranged parallel to one of the diagonals of the headrail 20. Because of the generally small size of the headrail 20 this angular relationship permits use of parts that are somewhat larger than would be possible if the locking mechanism were aligned in a parallel manner with the headrail 20. This generally diagonal arrangement also permits the lifting and lowering cord 30 to be presented to the operator to the front of the slats S since they pass through the headrail 20 by means of an opening 38 in the corner defined by the bottom wall 12 and one of the side walls 14 of the headrail.

Supported for rotation in and between the walls 28 is a guide roller 40. The roller 40 is mounted in suitable openings 52 in the walls 28 for rotation with respect to the walls. The guide roller 40 is retained in position by means of flanges 54 on the exterior of the walls 28, although various mechanically equivalent means for retaining the roller may be utilized.

Each of the walls 28 also has a slot 44. The slots 44 are in alignment with each other and at their upper ends approach the guide roller 40. The tracks 44 extend from their upper end downward and away from the guide roller 40. These slots 44 constitute a track for the locking pin 60 which is loosely mounted therein for rotation and for movement along the slots 44 between the upper (locked) and lower (unlocked) positions. In FIG. 1 the locking pin 60 is shown in the unlocked position. Flanges 56 retain the locking pin in position though other mechanically equivalent structures may be utilized.

Each of the walls 28 also has a slot 58. The slots 58 are in alignment with each other and support a helper pin 50 which is mounted in said slots 58 for rotation with respect thereto and for movement along the slots from a first position close to the unlocked position of the locking pin and a second position away from the unlocked position of the locking pin. The helper pin 50 is shown in its first mentioned position (adjacent the locking pin) in FIG. 1. Flanges 62 retain the helper pin 50 in the track provided by the slots 58 though other mechanically equivalent structures may be utilized.

As will be seen from FIG. 1 the flexible lifting and lowering member 30 which may be of any suitable material such as natural or synthetic cords, wire, fine chain, or the like, comprises two runs or elements 32 and 34 which pass through the opening 38 in the headrail 20 and then upwardly through opening 42 in the sloped portion 24 of the housing. The cords 32 and 34 then pass between the helper pin 50 and the locking pin 60 and then upwardly over the guide roller 40. One of the runs of cord 32 then passes along the headrail 20 and downwardly through an opening 66 in the bottom 12 of the headrail. The cord 32 then passes downwardly through slots 68 in each of the slats S. At its lower end it is attached to the bottom rail of the venetian blind (not shown). The other cord 34 passes along the headrail 20 to the opposite end (not shown) of the venetian blind where it passes through another hole (not shown) in the bottom 12, down through other holes (not shown) in the slats S and is attached adjacent to the opposite end of the bottom rail (not shown).

Figure 2:
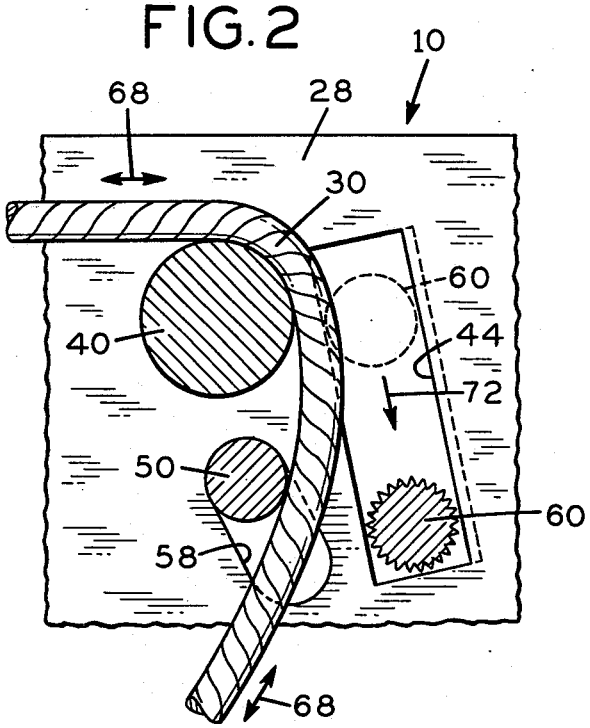
FIG. 2 is a cross section through a portion of the locking mechanism taken between the upright walls thereof, and showing the locking pin in solid lines in its unlocked position while the blind is being adjusted.
Figure 3:
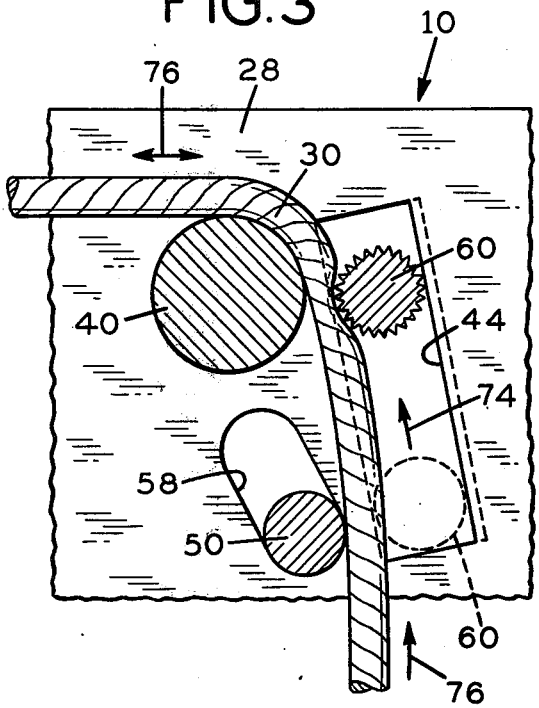
FIG. 3 is a view like FIG. 2, showing the locking pin in its locked position in solid lines.

As perhaps best shown in FIGS. 2 and 3 the aligned slots 58, which comprise the track for the helper pin 50 are arranged at an angle that diverges upwardly with respect to the slots 44 which provide the track for the locking pin 60. Additionally, the track 44 is itself positioned at an angle with respect to the vertical. At its upper end the track 44 approaches the guide roller 40 and at its lower end it is spaced downwardly and away from the guide roller 40. As shown in FIG. 2 the venetian blind is being adjusted in height either upwardly or downwardly as indicated by the arrows 68. The operator has grasped the free end of the lifting member 30 and moved the free end toward the left as viewed in FIG. 2. This movement has brought the member 30 out of engagement with the locking pin 60 which has dropped to its unlocked position as shown in solid lines in FIG. 2. This movement has also caused the lifting member 30 to move the helper pin 50 to the top of the track 58 away from the locking pin 60. In the position shown in FIG. 2 the lifting member 30 may be played upwardly through the mechanism to lower the blind or it may be pulled downwardly to raise the blind to any desired position.

Once the blind has been adjusted to the desired position the operator merely lets go of the lifting member 30 whereupon it will fall into the position shown in FIG. 3. The movement is in part accomplished by gravity in that the cord falls to assume a generally vertical position with respect to the guide roller 40. However, this movement of the lifting member 30 is insured by the movement of the helper roller 50 which upon release of the lifting member 30 by the operator is free to fall from the position of FIG. 2 to the position of FIG. 3. When the lifting member 30 has assumed the position shown in FIG. 3 it will be pressed against the serrated locking pin 60 (which will at that time be in the dash line position shown in FIG. 3) by the helper roller 50. The weight of the blind on the lifting member 30 then causes the lifting member 30 to move in the direction of the arrows 76. This movement of the lifting member 30 in the direction of the arrows 76 causes the locking pin 60 to roll along the track 44 upwardly in the direction of the arrow 74 until it reaches the solid line position shown in FIG. 3 at which point it pinches the lifting member 30 between the locking pin 60 and the guide roller 40 thus preventing further movement of the lifting member 30 in the direction of the arrows 76. It will be appreciated that the weight of the blind has in effect caused the lifting member 30 to become wedged between the guide roller 40 and the locking pin 60 and, further, the angularity of the track 44 with respect to the guide roller 40 assures that the weight of the blind continues to tend to increase the pinching action of the guide roller 40 and the locking pin 60. When it is again desired to adjust the blind the operator grasps the free end of the lifting member 30 and moves it to the left as viewed in FIGS. 2 and 3 to assume again the position shown in FIG. 2 in which position the lifting member 30 may be moved in either direction indicated by the double arrow heads 68 to raise or lower the blind as previously described.

FIGS. 4–9 show modifications of the helper means in which the helper and the guide are incorporated in essentially a single element. In each of FIGS. 4–9 those parts that are the same as those shown in FIGS. 1–3 carry the same reference numerals while those parts which are different for the particular modification carry new and different reference numerals.

Figure 4:
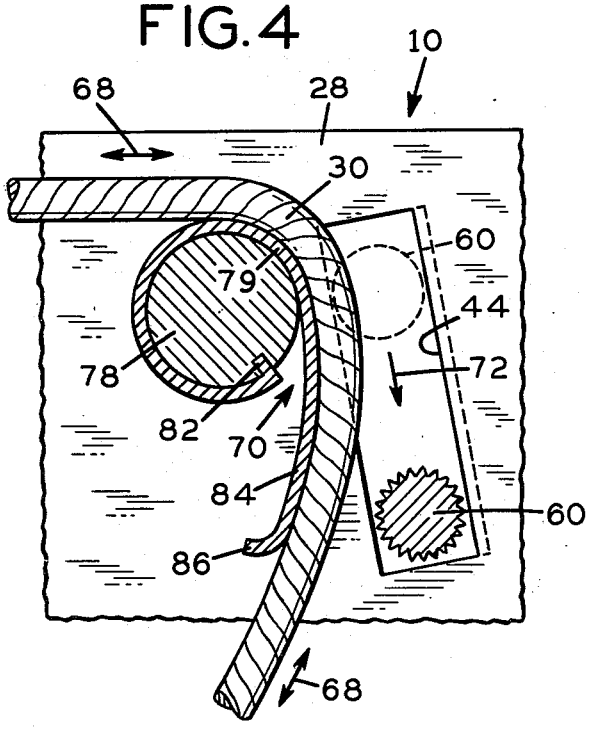
FIGS. 4 and 5 show a second embodiment of the invention with the locking pin in its unlocked and locked positions, respectively.
Figure 5:
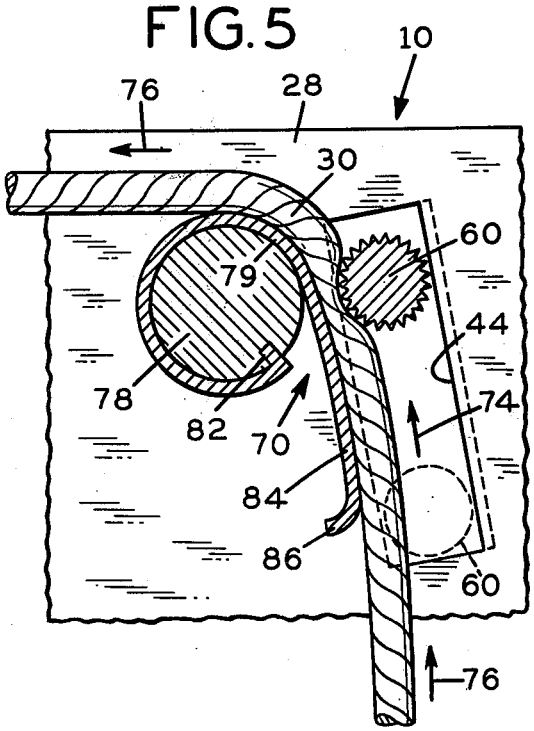

FIGS. 4 and 5 generally correspond to FIGS. 2 and 3 respectively except for the use of a different guide and helper mechanism. As shown in FIG. 4 the guide and helper mechanism is generally indicated at 70 and includes a generally upper guiding portion 79 and a lower helper portion 84. The guide and helper mechanism 70 is made of spring steel and has one end bent to form a flange 82 which is inserted in a receiving groove in a fixed roller 78. The fixed roller 78 is fixed to and between the upright walls 28. At its other end 86 the guide and helper mechanism 70 is bent away from the lifting member 30 (to the left in FIG. 4) merely to provide a smooth surface and avoid a sharp edge that might catch the lifting member 30. Upon movement of the lifting member 30 to the left by the operator to the position shown in FIG. 4 the helper portion 84 of the guide and helper mechanism 70 flexes since it is made of spring steel and with a small downward movement the locking pin 60 is released from its dashed line position to move in the direction of the arrow 72 into its full line position shown in FIG. 4. In the position shown in FIG. 4 the lifting member 30 may now be moved in either direction indicated by the arrow heads 68 to raise or lower the blind.

Upon achieving the desired adjustment of the blind the operator releases the lifting member 30 whereupon the weight of the blind tends to move the lifting member 30 in the direction of the arrows 76 and at the same time the guiding and helper member 70 due to its spring steel nature straightens out again as shown in FIG. 5 thus bringing the lifting member 30 into contact with the locking pin 60 while it is in its dashed line position shown in FIG. 5. The weight of the blind causes the lifting member 30 to move in the direction of the arrows 76 thus rolling the locking member 60 upward along the track 44 in the direction of the arrow 74 the track 44 until it reaches the solid line position of FIG. 5 where it pinches the lifting member 30 between itself and the guiding portion 79 of the guide and helper mechanism 70.

Figure 6:
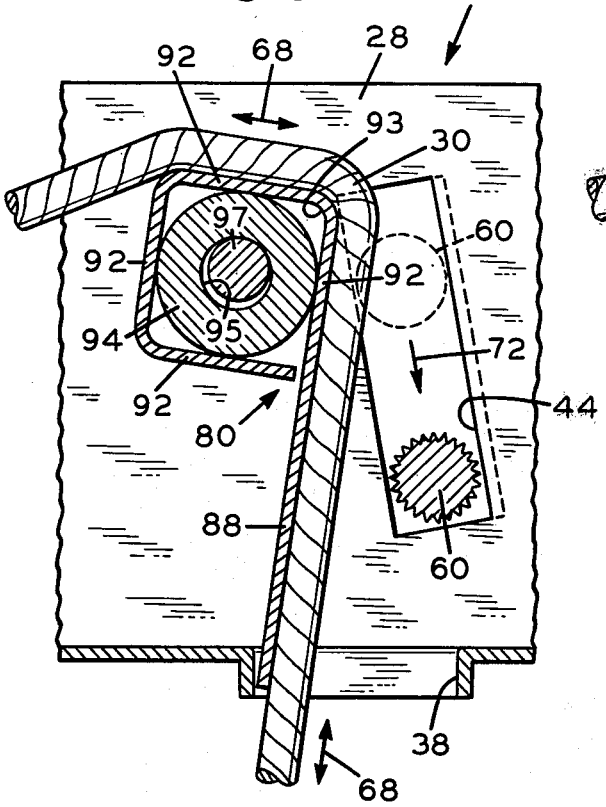
FIGS. 6 and 7 show a third embodiment of the invention with the locking pin in its unlocked and locked positions, respectively.
Figure 7:
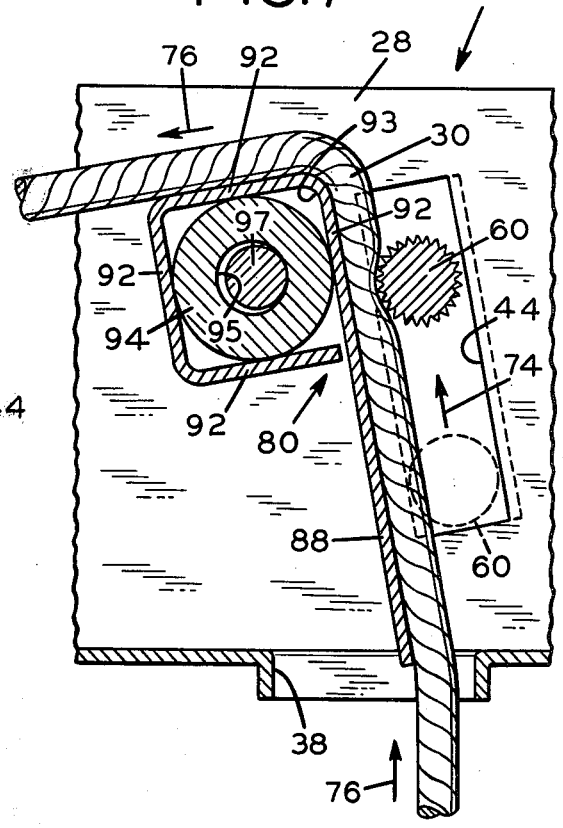

FIGS. 6 and 7 show another modified form of the guide and helper mechanism 80 and the figures correspond generally to FIGS. 4 and 5 respectively. In this embodiment the guide and helper mechanism 80 is made of stiffer metal and does not flex. It includes a helper portion 88 and an upper guide portion comprised of a box the four sides of which are indicated by the reference numerals 92. The box 92 is non-rotatably secured frictionally to a roller 94 mounted upon a fixed pin 96 secured to the opposite walls 28 of the locking mechanism housing. The roller 94 is mounted on the fixed pin 96 by means of a hole 95 which is larger than the pin 96 thus providing a loose rotational mounting for the entire assembly including the guide and helper mechanism 80. When it is desired to operate the device to raise or lower the blind the lifting member 30 is moved to the left to assume the position shown in FIG. 6 and given a slight downward pull to release the locking pin 60 from its dashed line position all as more fully described with reference to the two embodiments previously described. Upon achieving the desired amount of adjustment of the blind the operator releases the lifting member 30 whereupon the blind moves the lifting member 30 upwardly in the direction of the arrows 76. Due to the square nature of the box 92 and in particular the corner 93 the roller 94 and the guide and helper member 80 are pivoted from the position shown in FIG. 6 to that shown in FIG. 7 in which position the lifting member 30 engages the locking pin 60 in its dashed line position shown in FIG. 7 and then moves it in the direction of the arrow 74 along track 44 to its solid line position shown in FIG. 7 where it securely grips the lifting member 30 between the serrated circumference of the locking pin 60 and the guide portion 92.

Figure 8:
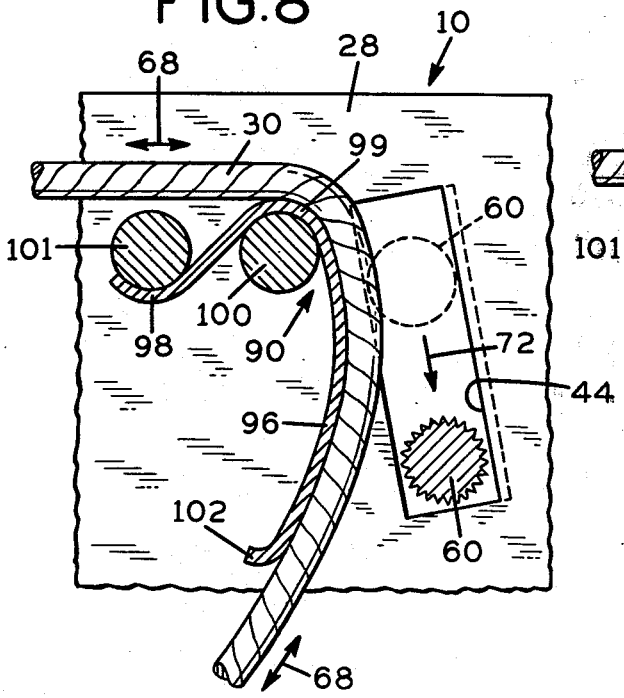
FIGS. 8 and 9 show a fourth embodiment of the invention with the locking pin in its unlocked and locked positions, respectively.
Figure 9:
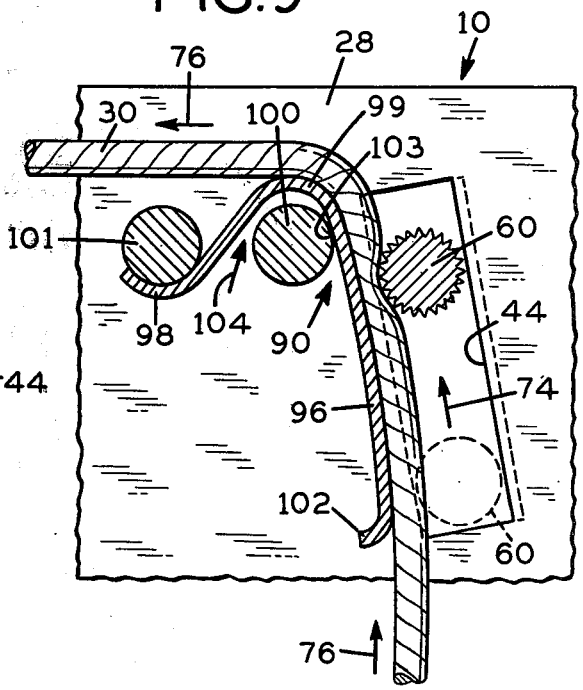

In the modification shown in FIGS. 8 and 9 which figures generally correspond to FIGS. 4 and 5 respectively the guide and helper mechanism 90 is made of spring steel and includes a flexible helper portion 96 and an upper guiding portion 99. At one end the helper portion 96 is bent at 102 in order to avoid sharp engagement with the material of the lifting member 30 in the same manner as the curved terminus 86 shown in the modification in FIGS. 4 and 5. At its other end the guide and helper mechanism 90 has a generally "S"shaped bend one loop of which comprises the guiding portion 99 positioned over a fixed roller 100 fixed to the walls 28 of the locking mechanism housing. The other loop of the "S"is positioned under and in engagement with the fixed roller 101 secured to the opposite parallel walls 28 of the housing. In the "at rest"or locked position the parts are in the position shown in FIG. 9. When it is desired to adjust the blind the operator grips the free end of the lifting member 30, moves it to the left as shown in FIG. 8 and gives it a slight downward pull which releases the locking pin from its solid line position shown in FIG. 9 (dashed line position of FIG. 8) and causes it to fall in the direction of the arrow 72 into its solid line position shown in FIG. 8. It will be noted that in the "at rest"position shown in FIG. 9 the guiding portion 99 has lifted off from its engagement with the roller 100 due to the weight of the blind on the end of the lifting member 30 and the fact that the guide and helper mechanism 90 is free to pivot about the fixed roller 101 by means of the loop 98. When the operator begins moving the lifting member 30 to the left and downwardly as aforesaid this causes the guide and helper member 90 to pivot in the opposite direction about the fixed roller 101 and brings the guide portion 99 into engagement with the other fixed roller 100 as shown in FIG. 8. At the same time the helper portion of the mechanism 90 flexes permitting the dropping of the locking pin 60 as just described.

Upon achieving the desired adjustment of the blind the operator releases the lifting member 30 whereupon the weight of the blind will cause the same to move in the direction of the arrow 76 while at the same time the flexed helper portion 96 reassumes its generally straight shape as shown in FIG. 9. This brings the lifting member 30 into engagement with the locking pin 60 in its dashed line position of FIG. 9 whereupon continued movement of the lifting member 30 in the direction of the arrows 76 causes the lifting member 30 to effect the upward movement of the locking pin 60 in the direction of the arrow 74 along track 44. As the locking pin 60 begins to pinch the locking member 30 between itself and the guide portion 99 of the guide and helper means 90 the guide and helper means 90 pivots counter-clockwise around the pin 101 thus effecting a lifting of the guiding portion 99 away from the pin 100. At the same time, however, contact between the guiding portion 99 and the pin 100 is maintained in the area 103 thus insuring that the lifting member 30 is pinched between the locking pin 60 and the guiding portion 99 which at this time is for all practical purposes fixed.

I claim:

1. A cord locking mechanism for a venetian blind comprising a lock housing, a flexible blind lifting and lowering member, a guide mounted in said housing for guiding said flexible member, a track in said housing, a locking pin mounted for movement in said track to and from a first position close to said guide and a second position remote from said guide, said flexible member extending between said guide and said locking pin, said pin when in said first position serving to grip said flexible member between said guide and said pin for preventing movement of said flexible member in one direction, helper means mounted for movement in said housing toward and away from the second position of said pin for urging said flexible member into engagement with said pin when said pin is in said second position and said helper means being so mounted as to move away from the second position of said pin upon movement of said flexible member away from said pin to raise or lower said blind.

2. The device of claim 1 in which said guide and said helper means are separate elements.

3. The device of claim 1 in which said guide and helper means are portions of a single physical element.

4. The device of claim 3 including said single element being a flat spring, a fixed pin, one end portion of said flat spring being said guide and being entrained over said fixed pin, and the other end portion of said flat spring being said helper means.

5. The device of claim 2 in which said helper means comprises a second track in said housing disposed at an angle to said first mentioned track and a helper pin mounted in said track for movement therealong.

6. The device of claim 4 in which said flat spring has a first terminus secured to said fixed pin, said one end portion entrained over said fixed pin is in engagement with the circumference of said fixed pin and said other portion extends outwardly of said fixed pin.

7. The device of claim 3 including a freely rotatable roller mounted in said housing, said single element being a substantially flat material, one end portion of said single element being shaped and dimensioned to substantially fixedly embrace the circumference of said freely rotatable roller, the remainder of said single element extending outwardly of said roller, said outwardly extending remainder providing said helper means.

8. The device of claim 4 including a second fixed pin, said one end portion being entrained in one direction about said second pin and in the opposite direction over said first mentioned fixed pin, said entrainment of said one portion with respect to said fixed pins being loose, and the other end portion extending outwardly from said first mentioned fixed pin to provide said helper means.

* * * * *